US012752393B2

(12) United States Patent
Go et al.

(10) Patent No.: US 12,752,393 B2
(45) Date of Patent: Oct. 6, 2026

(54) CONDITIONER AND CHEMICAL MECHANICAL POLISHING APPARATUS INCLUDING THE SAME

(71) Applicant: SAMSUNG ELECTRONICS CO., LTD., Suwon-si (KR)

(72) Inventors: Yeonsu Go, Suwon-si (KR); Donghoon Kwon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 451 days.

(21) Appl. No.: 18/214,857

(22) Filed: Jun. 27, 2023

(65) Prior Publication Data

US 2024/0173820 A1 May 30, 2024

(30) Foreign Application Priority Data

Nov. 30, 2022 (KR) ..... 10-2022-0163764

(51) Int. Cl.
*B24B 53/12* (2006.01)
*B24B 1/04* (2006.01)
*B24B 53/017* (2012.01)

(52) U.S. Cl.
CPC ..... *B24B 53/12* (2013.01); *B24B 1/04* (2013.01); *B24B 53/017* (2013.01)

(58) Field of Classification Search
CPC ..... H01L 21/30625; H01L 21/3212; B24B 53/017; B24B 53/12; B24B 53/005; B24B 53/001; B24B 53/02; B08B 3/12
USPC ..... 451/56, 443, 72, 41, 444
See application file for complete search history.

(56) References Cited

U.S. PATENT DOCUMENTS 5,245,796 A * 9/1993 Miller ..... B24B 37/107 451/36
6,083,085 A * 7/2000 Lankford ..... B24B 53/017 451/910
6,241,587 B1 6/2001 Drill et al.
6,872,132 B2 * 3/2005 Elledge ..... B24B 49/003 451/6
7,559,824 B2 7/2009 Park et al.
9,138,861 B2 * 9/2015 Wu ..... B24B 53/017
(Continued)

FOREIGN PATENT DOCUMENTS

JP 2004-363305 A 12/2004
KR 20000023767 A * 4/2000 ..... B24B 17/00
KR 10-2004-0040965 A 5/2004
(Continued)

OTHER PUBLICATIONS

Machine translation of KR-20190078856-A (Year: 2019).*
Machine translation of KR-20000023767-A (Year: 2000).*

*Primary Examiner* — Robert F Neibaur
(74) *Attorney, Agent, or Firm* — Sughrue Mion, PLLC

(57) ABSTRACT

Provided is a conditioner including a conditioning arm on a polishing pad that is configured to chemically mechanically polish a substrate based on slurry, a conditioning disk on the conditioning arm that is configured to condition the polishing pad, a dilution solution injector on a first side of the conditioning arm and configured to inject a dilution solution to the slurry introduced into a space under the conditioning disk, and a sonicator on a second side of the conditioning arm and configured to apply an ultrasonic wave to debris generated from the polishing pad.

20 Claims, 6 Drawing Sheets

(56) References Cited

U.S. PATENT DOCUMENTS

2015/0314417 A1* 11/2015 Sun ..... B24B 53/007
451/443
2023/0390895 A1* 12/2023 Wu ..... B24B 53/017

FOREIGN PATENT DOCUMENTS

KR 10-2007-0029418 A 3/2007
KR 10-2008-0040451 A 5/2008
KR 20190078856 A * 7/2019 ..... B24B 53/12

* cited by examiner

CONDITIONER AND CHEMICAL MECHANICAL POLISHING APPARATUS INCLUDING THE SAME

CROSS-REFERENCE TO RELATED APPLICATION

This application claims priority to Korean Patent Application No. 10-2022-0163764, filed on Nov. 30, 2022 in the Korean Intellectual Property Office (KIPO), the disclosure of which is incorporated herein in its entirety by reference.

BACKGROUND

1. Field

Example embodiments of the present disclosure relate to a conditioner and a chemical mechanical polishing apparatus including the same. More particularly, example embodiments relate to a conditioner configured to condition a polishing pad and a chemical mechanical polishing apparatus including the conditioner.

2. Description of Related Art

Generally, a layer on a semiconductor substrate may be planarized using a chemical mechanical polishing (CMP) apparatus. The CMP apparatus may include a polishing head, a platen, a polishing pad, a slurry arm, a conditioner, etc. The polishing head may be configured to hole the semiconductor substrate. The platen may be arranged under the polishing head. The polishing pad may be arranged on an upper surface of the platen to polish the semiconductor substrate. The slurry arm may be configured to supply slurry to the polishing pad. The conditioner may be configured to condition the polishing pad.

According to related arts, byproducts may be generated by contacting a conditioning disk of the conditioner with the polishing pad. The byproducts may be coagulated by ions in the slurry to form a large particle. When the large particle infiltrates into the polishing head, a scratch may be generated on the semiconductor substrate held by the polishing head.

SUMMARY

One or more example embodiments provide a conditioner that may prevent a substrate from being damaged by byproducts generated in a conditioning process.

One or more example embodiments also provide a chemical mechanical polishing apparatus including the above-mentioned conditioner.

According to an aspect of an example embodiment, there is provided a conditioner including a conditioning arm on a polishing pad that is configured to chemically mechanically polish a substrate based on slurry, a conditioning disk on the conditioning arm that is configured to condition the polishing pad, a dilution solution injector on a first side of the conditioning arm and configured to inject a dilution solution to the slurry introduced into a space under the conditioning disk, and a sonicator on a second side of the conditioning arm and configured to apply an ultrasonic wave to debris generated from the polishing pad.

According to another aspect of an example embodiment, there is provided a conditioner including a conditioning arm on a polishing pad that is configured to chemically mechanically polish a substrate based on slurry, a conditioning disk on the conditioning arm that is configured to condition the polishing pad, a dilution solution injector having a semi-ring shape and adjacent to a front portion of the conditioning arm oriented in a direction opposite to a rotation direction of the polishing pad, the dilution solution injector being configured to inject a dilution solution to the slurry introduced into a space under the conditioning disk, a sonicator having a semi-ring shape and adjacent to a rear portion of the conditioning arm opposite to the front portion, the sonicator being configured to apply an ultrasonic wave to debris generated from the polishing pad, and a cleaner configured to clean the sonicator.

According to another aspect of an example embodiment, there is provided a chemical mechanical polishing (CMP) apparatus including a polishing head configured to hold a substrate, a platen under the polishing head, a polishing pad on the platen and configured to chemically mechanically polish the substrate, a slurry arm configured to supply slurry to the polishing pad, a conditioner configured to condition the polishing pad, a dilution solution injector on a first side of the conditioner, the dilution solution injector being configured to inject a dilution solution to the slurry introduced into a space under the conditioner, and a sonicator on a second side of the conditioner, the sonicator being configured to apply an ultrasonic wave to debris generated from the polishing pad.

BRIEF DESCRIPTION OF DRAWINGS

Example embodiments will be more clearly understood from the following detailed description taken in conjunction with the accompanying drawings, in which.

DETAILED DESCRIPTION OF EMBODIMENTS

Hereinafter, example embodiments will be explained in detail with reference to the accompanying drawings.

It will be understood that when an element or layer is referred to as being "over," "above," "on," "below," "under," "beneath," "connected to" or "coupled to" another element or layer, it can be directly over, above, on, below, under, beneath, connected or coupled to the other element or layer or intervening elements or layers may be present. In contrast, when an element is referred to as being "directly over," "directly above," "directly on," "directly below," "directly under," "directly beneath," "directly connected to" or "directly coupled to" another element or layer, there are no intervening elements or layers present.

Figure 1:
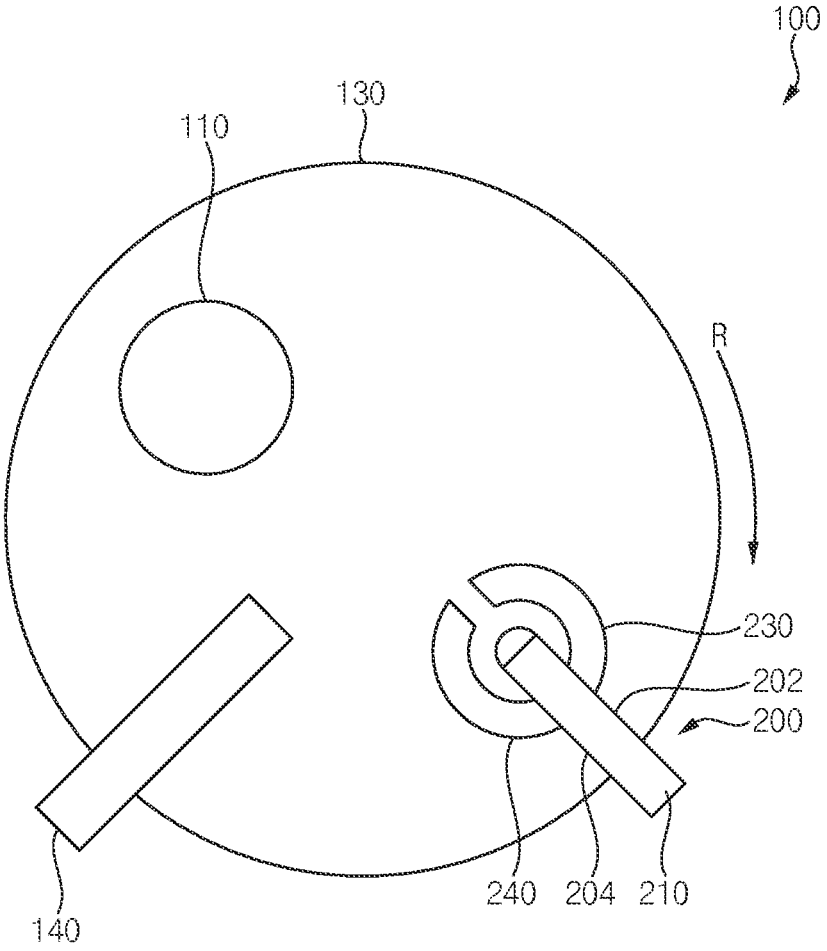
FIG. 1 is a plan view illustrating a CMP apparatus in accordance with example embodiments.
Figure 2:
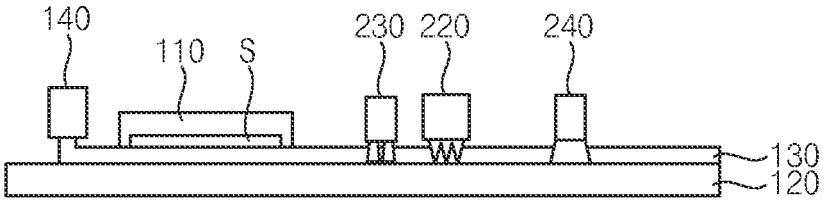
FIG. 2 is a cross-sectional view illustrating the CMP apparatus in FIG. 1.

FIG. 1 is a plan view illustrating a CMP apparatus in accordance with example embodiments and FIG. 2 is a cross-sectional view illustrating the CMP apparatus in FIG. 1.

Referring to FIGS. 1 and 2, a CMP apparatus 100 of example embodiments may include a polishing head 110, a platen 120, a polishing pad 130, a slurry arm 140 and a conditioner 200.

The polishing head 110 may be configured to hold a substrate S. The substrate S may be fixed to a lower surface of the polishing head 110 in a vertical direction. In example embodiments, the substrate S may include, for example, a semiconductor substrate, a glass substrate, and the like, but embodiments are not limited thereto.

The platen 120 may be arranged under the polishing head 110 in the vertical direction. The polishing pad 130 may be arranged on an upper surface platen 120. The polishing pad 130 may be between the polishing head 110 and the platen 120. The platen 120 may be rotated with respect to a vertical axis. For example, the platen 120 may be rotated in an arrow direction R in FIG. 1. Thus, the polishing pad 130 may also be rotated together with the platen 120 with respect to the vertical axis along the arrow direction R. The polishing pad 130 may chemically mechanically polish a layer on the substrate S, for example, a metal layer using slurry provided from the slurry arm 140.

The conditioner 200 may be arranged over the platen 120 in the vertical direction. The conditioner 200 may include a conditioning arm 210, a conditioning disk 220, a dilution solution injector 230 and a sonicator 240. The conditioning disk 220 may be installed at an end of the conditioning arm 210. The conditioning disk 220 may make contact with the upper surface of the polishing pad 130 to condition the polishing pad 130.

The dilution solution injector 230 may be arranged at a first side of the conditioning arm 210. The dilution solution injector 230 may inject a dilution solution to the slurry introduced into a space under the conditioning disk 220 to dilute the slurry. A coagulation of debris, which may be generated in a conditioning process, caused by ions in the slurry may be suppressed by the dilution of the slurry.

In example embodiments, the dilution solution injector 230 may be arranged at a front portion 202 of the conditioning arm 210 oriented in a direction opposite to a rotation direction R of the polishing pad 130 rotating in the vertical axis. The front portion 202 of the conditioning arm 210 may be a portion oriented toward a direction opposite to the rotation direction R of the polishing pad 130. Thus, when the conditioning arm 210 is positioned on a plane on which the polishing pad 130 is positioned, the front portion 201 of the conditioning arm 210 may first make contact with the polishing pad 130 when being rotated along the rotation direction R. In example embodiments, the rotation direction R of the polishing pad 130 may be a clockwise direction, but embodiments are not limited thereto.

Therefore, the dilution solution injector 230 may inject the dilution solution to the slurry introduced into the space under the conditioner 200 by the polishing pad 130 being rotated along the rotation direction R. For example, the dilution solution injected from the dilution solution injector 230 may form a water curtain at the front portion 202 of the conditioner 200. The dilution solution may include deionized (DI) water, but embodiments are not limited thereto.

Further, the dilution solution injector 230 may be fixed to the front portion 202 of the conditioning arm 210. Thus, the dilution solution injector 230 may be rotated together with the conditioning arm 210. Particularly, the dilution solution injector 230 may have a semi-ring shape provided adjacent to and surrounding a portion of the front portion 202 of the conditioning arm 210, but embodiments are not limited thereto. According to another embodiment, the dilution solution injector 230 may have other shapes provided adjacent to and surrounding at least a portion the front portion 202 of the conditioning arm 210, for example, a semi-rectangular shape. The shape of the dilution solution injector 230 may not be restricted within the shape configured to surround the front portion 202 of the conditioning arm 210. The dilution solution injector 230 may have other shapes configured to inject the dilution solution to the front portion 202 of the conditioning arm 210.

The sonicator 240 may be arranged at a second side of the conditioning arm 210. For example, the sonicator 240 may be opposite to the dilution solution injector 230 with respect to the conditioning arm 210. The sonicator 240 may apply an ultrasonic wave to the debris to sonicate the coagulated debris. Thus, the coagulated debris may not infiltrate into the polishing pad 110. As a result, a damage of the substrate S by the coagulated debris may also be suppressed.

In example embodiments, the sonicator 240 may be arranged at a rear portion 204 of the conditioning arm 210 opposite to the front portion 202. The front portion 202 is oriented in a direction opposite to the rotation direction R of the polishing pad 130. As mentioned above, because the front portion 202 of the conditioning arm 210 may face the rotation direction R of the polishing pad 130, the rear portion 204 of the conditioning arm 210 oriented in the rotation direction R of the polishing pad 130. Thus, when the conditioning arm 210 is substantially coplanar with the polishing pad 130, the rear portion 204 of the conditioning arm 210 may lastly make contact with the polishing pad 130 when being rotated along the rotation direction R. The sonicator 240 may apply the ultrasonic wave to the debris discharged from the conditioner 200 to sonicate the coagulated debris.

Further, the sonicator 240 may be fixed to the rear portion 204 of the conditioning arm 210. Thus, the sonicator 240 may be rotated together with the conditioning arm 210. For example, the sonicator 240 may have a semi-ring shape provided adjacent to and surrounding the rear portion 204 of the conditioning arm 210, but embodiments are not limited thereto. According to another embodiment, the sonicator 240 may have other shapes provided adjacent to and surrounding the rear portion 204 of the conditioning arm 210, for example, a semi-rectangular shape. The shape of the sonicator 240 may not be restricted within the shape configured to surround the rear portion 204 of the conditioning arm 210. The sonicator 240 may have other shapes configured to apply the ultrasonic wave to the rear portion 204 of the conditioning arm 210.

Figure 3:
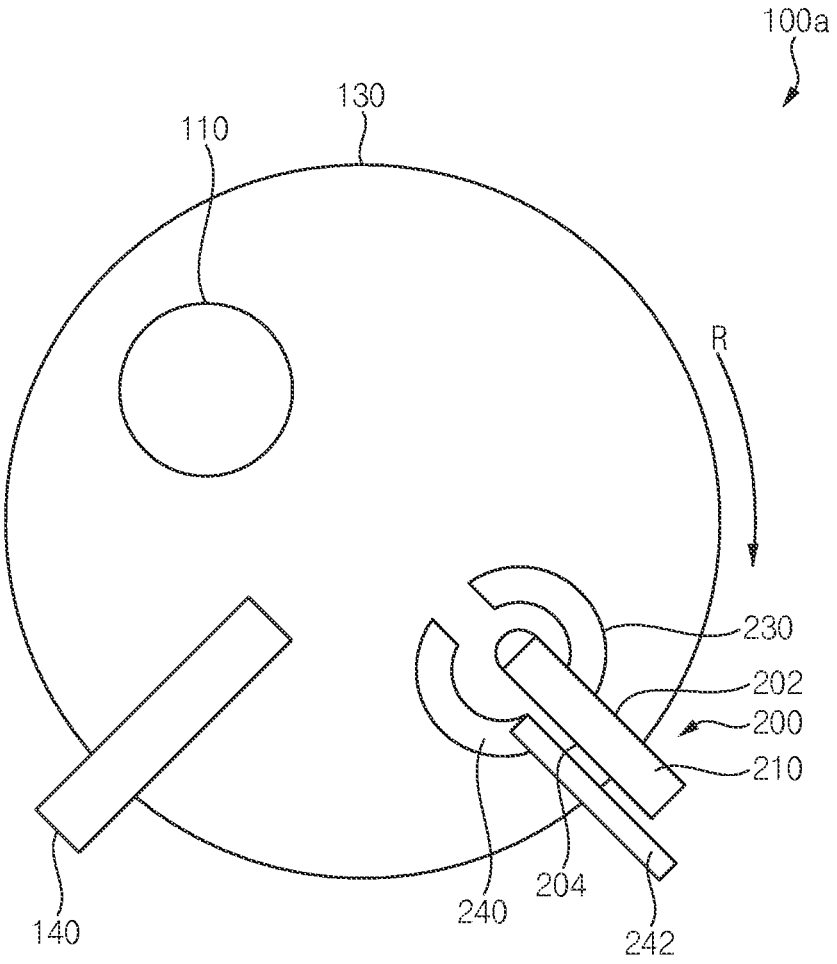
FIG. 3 is a plan view illustrating a CMP apparatus in accordance with example embodiments.

FIG. 3 is a plan view illustrating a CMP apparatus in accordance with example embodiments.

A CMP apparatus 100*a* of example embodiments may include elements substantially the same as those of the CMP apparatus 100 in FIG. 1 except for a sonicator. Thus, the same reference numerals may refer to the same elements and any further illustrations with respect to the same elements may be omitted herein for brevity.

Referring to FIG. 3, a sonicator 240 of example embodiments may not be fixed to the rear portion 204 of the conditioning arm 210. The sonicator 240 may further include an arm 242. The arm 242 may be connected to the sonicator 240. The arm 242 may be rotated over the polishing pad 130 with respect to the vertical axis. Thus, the sonicator 240 may also be rotated with respect to the vertical axis by the arm 242. For example, the sonicator 240 may be rotated independently upon the rotation of the conditioning arm 210.

Figure 4:
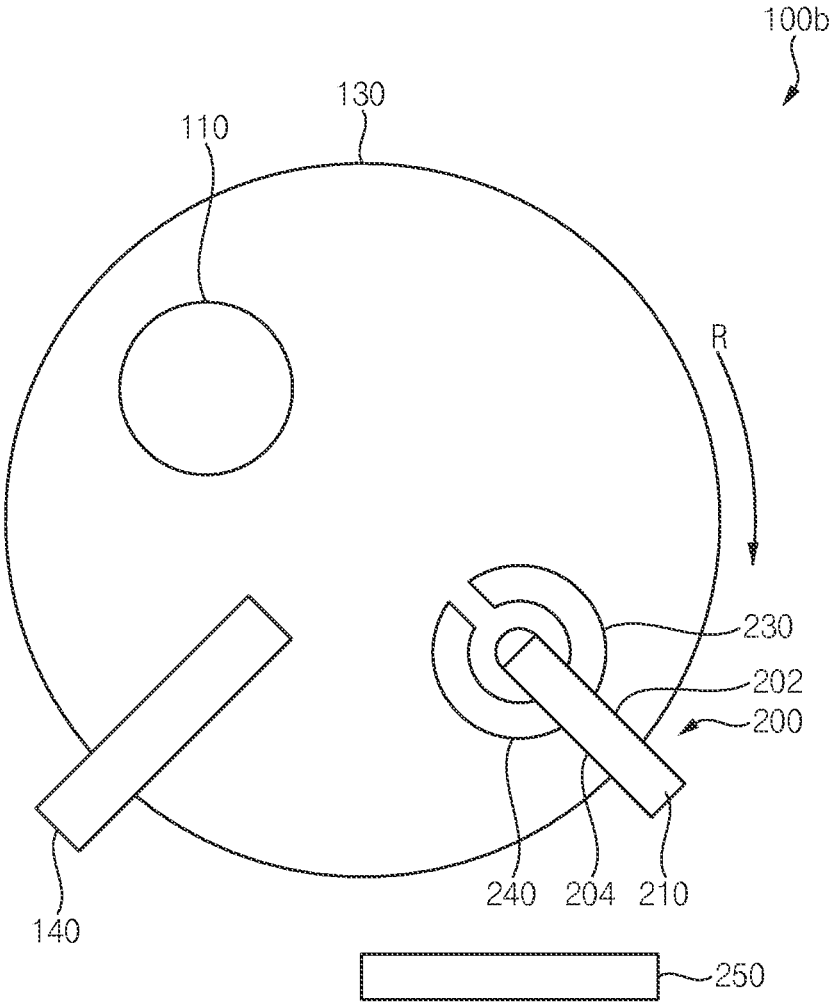
FIG. 4 is a plan view illustrating a CMP apparatus in accordance with example embodiments.

FIG. 4 is a plan view illustrating a CMP apparatus in accordance with example embodiments.

A CMP apparatus 100*b* of example embodiments may include elements substantially the same as those of the CMP apparatus 100 in FIG. 1 except for further including cleaner. Thus, the same reference numerals may refer to the same elements and any further illustrations with respect to the same elements may be omitted herein for brevity.

Referring to FIG. 4, the CMP apparatus 100*b* of example embodiments may further include a cleaner 250.

The cleaner 250 may be arranged at an outskirt of the polishing pad 130 adjacent to the sonicator 240. The cleaner 250 may be configured to periodically clean the sonicator 240. In example embodiments, the cleaner 250 may include a brush, but embodiments are not limited thereto.

For example, the sonicator 240 may make contact with a layer of the slurry to generate a cavitation. Thus, a very narrow gap may be maintained between the sonicator 240 and the polishing pad 130. The very narrow gap may cause continuous contaminations of a lower surface of the sonicator 240 by the debris generated from the polishing pad 130. Therefore, in order to maintain the capacity of the sonicator 240, the sonicator 240 may need to be cleaned periodically.

When the cleaning of the sonicator 240 is needed, the sonicator 240 may be rotated toward the cleaner 250 together with the conditioning arm 210. When the cleaner 250 may include the brush, the lower surface of the sonicator 240 may be positioned over the brush. The brush may make frictional contact with the lower surface of the sonicator 240 to remove contaminants from the lower surface of the sonicator 240.

Figure 5:
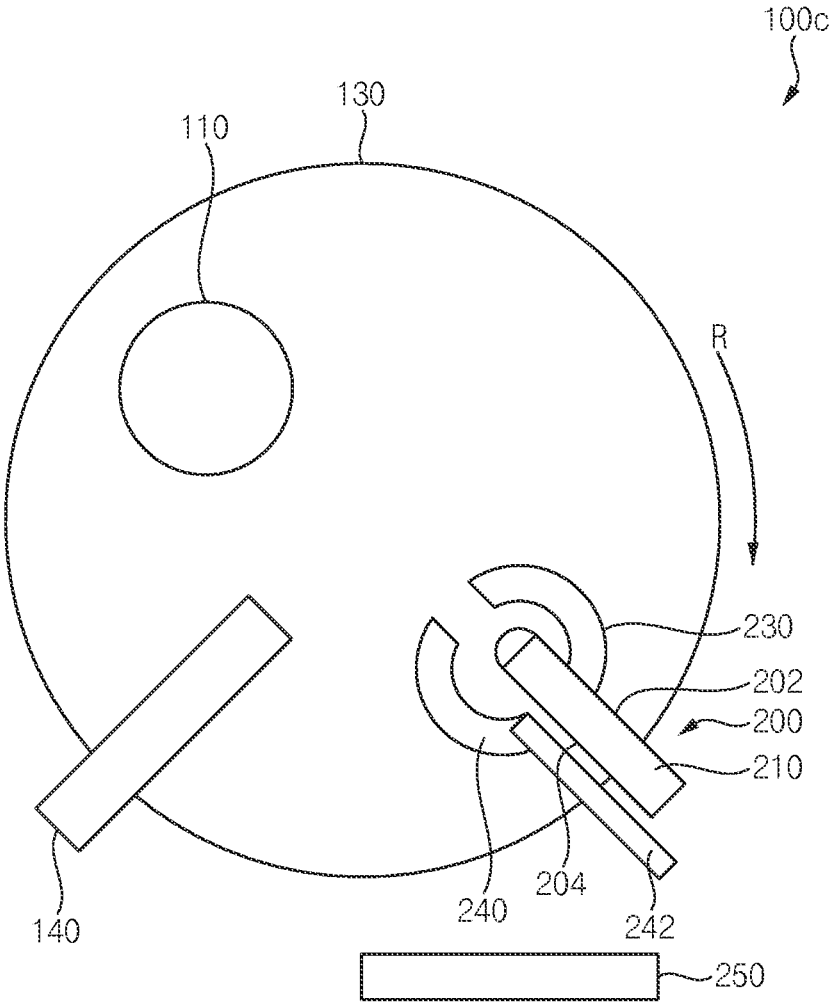
FIG. 5 is a plan view illustrating a CMP apparatus in accordance with example embodiments.

FIG. 5 is a plan view illustrating a CMP apparatus in accordance with example embodiments.

A CMP apparatus 100*c* of example embodiments may include elements substantially the same as those of the CMP apparatus 100*a* in FIG. 3 except for further including cleaner. Thus, the same reference numerals may refer to the same elements and any further illustrations with respect to the same elements may be omitted herein for brevity.

Referring to FIG. 5, the CMP apparatus 100*c* of example embodiments may further include a cleaner 250.

The cleaner 250 may be arranged at an outer part of the polishing pad 130 adjacent to the sonicator 240. The cleaner 250 may be configured to periodically clean the sonicator 240. In example embodiments, the cleaner 250 may include a brush, but embodiments are not limited thereto.

When the cleaning of the sonicator 240 may be required, the sonicator 240 may be rotated toward the cleaner 250 by the arm 242. When the cleaner 250 includes the brush, the lower surface of the sonicator 240 may be positioned over the brush. The brush may make frictional contact with the lower surface of the sonicator 240 to remove contaminants from the lower surface of the sonicator 240.

Figure 6:
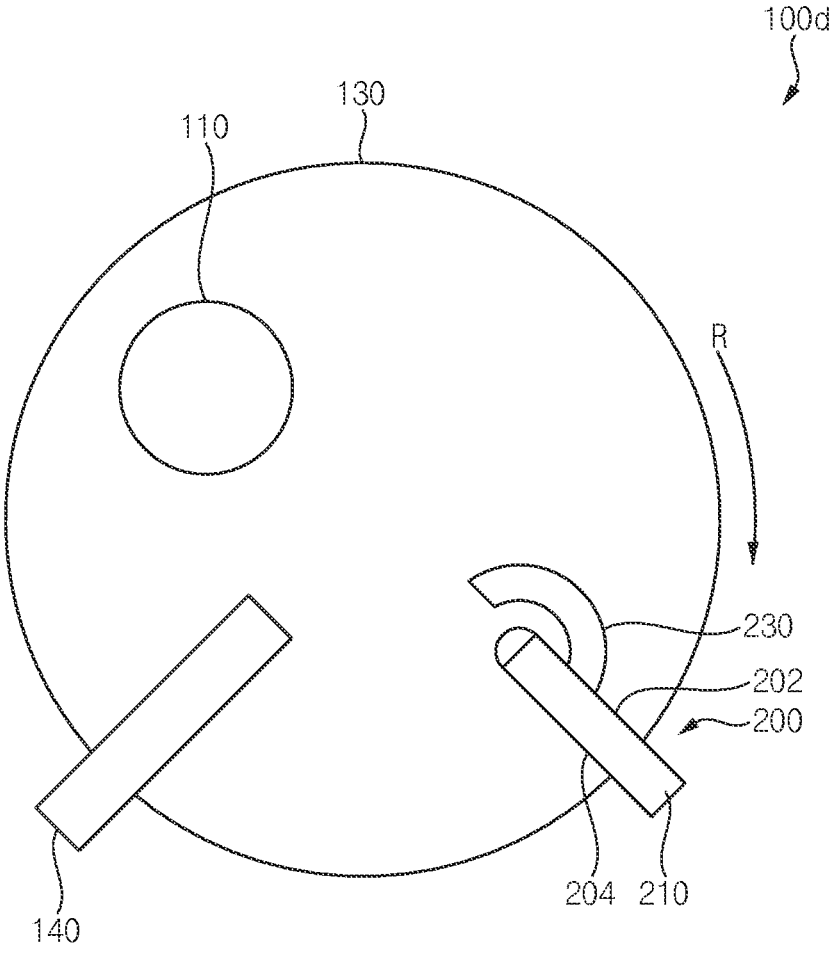
FIG. 6 is a plan view illustrating a CMP apparatus in accordance with example embodiments.

FIG. 6 is a plan view illustrating a CMP apparatus in accordance with example embodiments.

A CMP apparatus 100*d* of example embodiments may include elements substantially the same as those of the CMP apparatus 100 in FIG. 1 except for a conditioner. Thus, the same reference numerals may refer to the same elements and any further illustrations with respect to the same elements may be omitted herein for brevity.

Referring to FIG. 6, a conditioner 200 of example embodiments may include only the dilution solution injector 230 and the conditioner 200 may not include the sonicator.

Although the conditioner 200 may not include the sonicator, the dilution solution injector 230 may suppress the damage of the substrate S. For example, only the dilution of the slurry, which may be generated by injecting the dilution solution to the slurry under the conditioning disk 220 from the dilution solution injector 230, may suppress the coagulation of the debris caused by the ions in the slurry.

Figure 7:
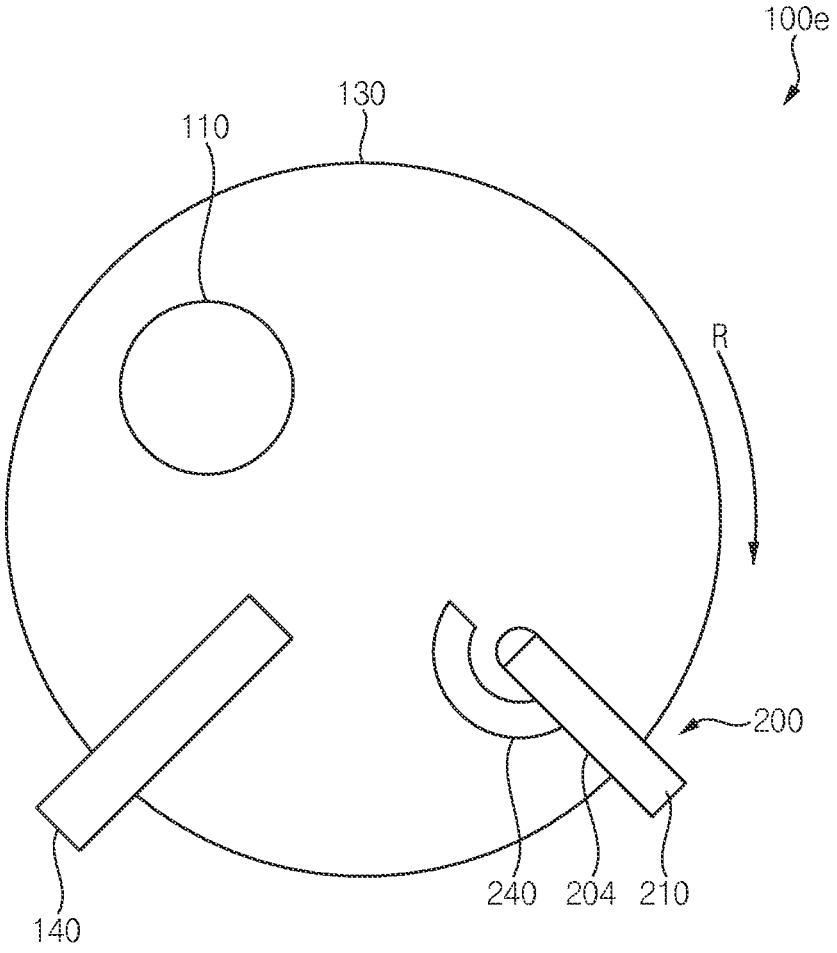
FIG. 7 is a plan view illustrating a CMP apparatus in accordance with example embodiments.

FIG. 7 is a plan view illustrating a CMP apparatus in accordance with example embodiments.

A CMP apparatus 100*e* of example embodiments may include elements substantially the same as those of the CMP apparatus 100 in FIG. 1 except for a conditioner. Thus, the same reference numerals may refer to the same elements and any further illustrations with respect to the same elements may be omitted herein for brevity.

Referring to FIG. 7, a conditioner 200 of example embodiments may include only the sonicator 240 and may not include the dilution solution injector.

Although the conditioner 200 may not include the dilution solution injector, the sonicator 240 may suppress the damage of the substrate S. For example, only the sonication of the coagulated debris, which may be generated by applying the ultrasonic wave to the debris from the sonicator 240, may suppress the coagulation of the debris caused by the ions in the slurry.

According to example embodiments, the dilution solution injector may inject the dilution solution to the slurry introduced into the conditioner to dilute the slurry. Thus, a coagulation of the byproducts, which may be generated in a conditioning process, by ions in the slurry may be suppressed. Further, the sonicator may apply the ultrasonic wave to the byproducts discharged from the conditioner to sonicate the coagulated byproducts. Thus, the coagulated byproducts may not infiltrate into the polishing head so that a damage of the substrate may be prevented.

While example embodiments have been described with reference to the figures, it will be understood by those of ordinary skill in the art that various changes in form and details may be made therein without departing from the spirit and scope as defined by the following claims and their equivalents.

What is claimed is:

1. A conditioner comprising:

a conditioning arm on a polishing pad that is configured to chemically mechanically polish a substrate based on slurry;

a conditioning disk on the conditioning arm that is configured to condition the polishing pad;

a dilution solution injector on a first side of the conditioning arm and configured to inject a dilution solution to the slurry introduced into a space under the conditioning disk; and a sonicator on a second side of the conditioning arm and configured to apply an ultrasonic wave to debris generated from the polishing pad, wherein the dilution solution injector and the sonicator are provided on a same plane parallel to an upper surface of the polishing pad and spaced apart and separated from each other in a direction parallel to the upper surface of the polishing pad, and wherein the dilution solution injector is provided on the first side of the conditioning arm and the sonicator is provided on the second side of the conditioning arm opposite to the first side with respect to a rotation direction of the polishing pad.

2. The conditioner of claim 1, wherein the first side of the conditioning arm is a front portion of the conditioning arm oriented in a direction opposite to the rotation direction of the polishing pad.

3. The conditioner of claim 2, wherein the dilution solution injector has a shape to surround the front portion of the conditioning arm when viewed in a direction perpendicular to the upper surface of the polishing pad.

4. The conditioner of claim 3, wherein the dilution solution injector has a semi-ring shape when viewed in the direction perpendicular to the upper surface of the polishing pad.

5. The conditioner of claim 1, wherein the dilution solution comprises deionized (DI) water.

6. The conditioner of claim 1, wherein the second side of the conditioning arm is a rear portion of the conditioning arm oriented in the rotation direction of the polishing pad.

7. The conditioner of claim 6, wherein the sonicator has a shape to surround the rear portion of the conditioning arm when viewed in a direction perpendicular to the upper surface of the polishing pad.

8. The conditioner of claim 7, wherein the sonicator has a semi-ring shape when viewed in the direction perpendicular to the upper surface of the polishing pad.

9. The conditioner of claim 6, wherein the sonicator comprises an arm that is configured to rotate the sonicator with respect to a vertical axis.

10. The conditioner of claim 1, further comprising a cleaner configured to clean the sonicator.

11. The conditioner of claim 10, wherein the cleaner comprises a brush.

12. A conditioner comprising:

a conditioning arm on a polishing pad that is configured to chemically mechanically polish a substrate based on slurry;

a conditioning disk on the conditioning arm that is configured to condition the polishing pad;

a dilution solution injector having a semi-ring shape and adjacent to a front portion of the conditioning arm oriented in a direction opposite to a rotation direction of the polishing pad, the dilution solution injector being configured to inject a dilution solution to the slurry introduced into a space under the conditioning disk;

a sonicator having a semi-ring shape and adjacent to a rear portion of the conditioning arm opposite to the front portion, the sonicator being configured to apply an ultrasonic wave to debris generated from the polishing pad; and a cleaner configured to clean the sonicator, wherein the dilution solution injector and the sonicator are provided on a same plane parallel to an upper surface of the polishing pad and spaced apart and separated from each other in the direction parallel to the upper surface of the polishing pad.

13. The conditioner of claim 12, wherein the dilution solution injector is on the front portion of the conditioning arm.

14. The conditioner of claim 12, wherein the sonicator is on the rear portion of the conditioning arm.

15. The conditioner of claim 12, wherein the sonicator comprises an arm configured to rotate the sonicator with respect to a vertical axis.

16. The conditioner of claim 12, wherein the cleaner comprises a brush.

17. A chemical mechanical polishing (CMP) apparatus comprising:

a polishing head configured to hold a substrate;

a platen under the polishing head;

a polishing pad on the platen and configured to chemically mechanically polish the substrate;

a slurry arm configured to supply slurry to the polishing pad;

a conditioner configured to condition the polishing pad;

a dilution solution injector on a first side of the conditioner, the dilution solution injector being configured to inject a dilution solution to the slurry introduced into a space under the conditioner; and a sonicator on a second side of the conditioner, the sonicator being configured to apply an ultrasonic wave to debris generated from the polishing pad, wherein the dilution solution injector and the sonicator are provided on a same plane parallel to an upper surface of the polishing pad and spaced apart and separated from each other in a direction parallel to the upper surface of the polishing pad, and wherein the dilution solution injector is provided on the first side of the conditioner and the sonicator is provided on the second side of the conditioner opposite to the first side with respect to a rotation direction of the polishing pad.

18. The CMP apparatus of claim 17, wherein the dilution solution injector is adjacent to a front portion of the conditioner oriented in a direction opposite to the rotation direction of the polishing pad.

19. The CMP apparatus of claim 17, wherein the sonicator is adjacent to a rear portion of the conditioner oriented in the rotation direction of the polishing pad.

20. The conditioner of claim 17, further comprising a cleaner configured to clean the sonicator.

* * * * *